US009620869B2

(12) United States Patent
Listing et al.

(10) Patent No.: US 9,620,869 B2
(45) Date of Patent: Apr. 11, 2017

(54) CONTACT ELEMENT COMPRISING A LOOPED SPRING SECTION

(71) Applicants: Tyco Electronics AMP GmbH, Bensheim (DE); Tyco Electronics Corporation, Berwyn, PA (US)

(72) Inventors: Martin Listing, Langen (DE); David James Rhein, Memphis, MI (US)

(73) Assignees: Tyco Electronics Corporation, Berwyn, PA (US); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/626,077

(22) Filed: Feb. 19, 2015

(65) Prior Publication Data

US 2015/0236434 A1 Aug. 20, 2015

Related U.S. Application Data

(60) Provisional application No. 61/941,727, filed on Feb. 19, 2014.

(51) Int. Cl.
*H01R 24/00* (2011.01)
*H01R 4/48* (2006.01)
*H01R 13/02* (2006.01)

(52) U.S. Cl.
CPC ..... *H01R 4/4809* (2013.01); *H01R 13/02* (2013.01)

(58) Field of Classification Search
CPC . H01R 4/646; H01R 13/6582; H01R 13/6592
USPC ..... 439/660
See application file for complete search history.

(56) References Cited

U.S. PATENT DOCUMENTS 4,195,895 A * 4/1980 Ziegler ..... H01R 4/646 174/88 R
5,441,424 A * 8/1995 Morlion ..... H01R 24/568 439/578
9,362,631 B2 6/2016 Listing et al.
2011/0076869 A1* 3/2011 Braem ..... H01R 13/2407 439/188
2013/0012072 A1* 1/2013 Costello ..... H01R 13/18 439/660
2015/0099397 A1 4/2015 Listing et al.
2015/0236434 A1* 8/2015 Listing ..... H01R 13/02 439/660

FOREIGN PATENT DOCUMENTS

DE WO 2013190438 A1 * 12/2013 ..... H01R 9/0527
WO 2013156379 A1 10/2013

OTHER PUBLICATIONS

PCT Notification, PCT International Search Report and Written Opinion, International Application No. PCT/US2015/016564, dated May 20, 2015, 10 pages.
International Preliminary Report of Patentability, 6 pages, dated Aug. 23, 2016.
PCT Notification Concerning Transmittal of International Preliminary Report on Patentability, 1 page, dated Sep. 1, 2016.

* cited by examiner

*Primary Examiner* — Abdullah Riyami
*Assistant Examiner* — Nader Alhawamdeh
(74) *Attorney, Agent, or Firm* — Barley Snyder

(57) ABSTRACT

An electrical contact for an electric connector is disclosed having a looped spring portion. The looped spring portion has a connecting end, a contacting end curved back towards the connecting end, and at least one contacting region positioned on the contacting end.

18 Claims, 4 Drawing Sheets

CONTACT ELEMENT COMPRISING A LOOPED SPRING SECTION

CROSS-REFERENCE TO RELATED APPLICATION

This application claims priority under 35 U.S.C. §119(a)-(d) to U.S. Provisional Application No. 61/941,727, filed Feb. 19, 2014.

FIELD OF THE INVENTION

The invention generally relates to a contact element for an electrical connector, and more specifically, to a vibration resistant contact element for an electric connector.

BACKGROUND

Conventionally, electrical connectors house contact elements to contact a complementary contact elements positioned in a mating electrical connector, once the electrical connector and the mating electrical connector have been plugged together. Through these contact elements, energy and/or data signals may be transmitted from the electrical connector to the mating electrical connector and back. The contact elements may also be used to connect an electrical shield of the electric connector to the electrical shield of the mating electrical connector.

Some environments, such as vehicles, motors or machinery, subject these electrical connectors to strong vibrations. Such vibrations may quickly wear out the contact elements of the electric connector and mating connector if the contact elements are permitted to move relative to each other. High-frequency oscillations may damage a contact element more quickly than low-frequency oscillations, even if the amplitude of the high-frequency oscillations is much smaller than the amplitude of the low-frequency oscillations and may hardly be visible.

Therefore, there is a need for a small electrical contact element that exhibits reduced wear when subjected to high-frequency vibrations.

SUMMARY

An electrical contact for an electric connector has a looped spring portion. The looped spring portion has a connecting end, a contacting end curved back towards the connecting end, and at least one contacting region positioned on the contacting end.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
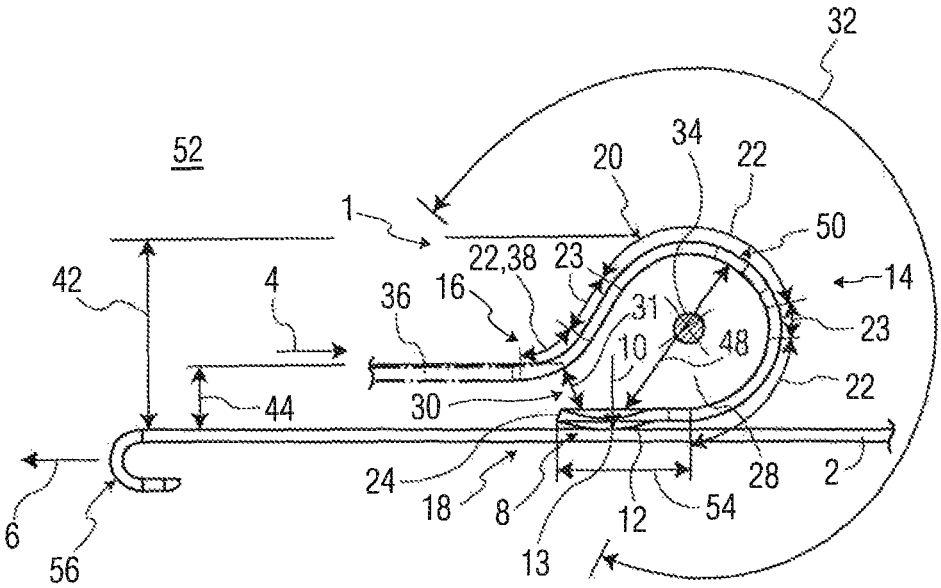
FIG. 1 is a sectional side view of an electrical contact.

In an embodiment of FIG. 1, a first contact 1 is connected to a complimentary second contact 2. The first contact 1 may be part of an electrical connector (not shown) which is connected to a mating electrical connector (not shown) by moving the connector in a mating direction 4 relative to the mating connector. The mating direction 4 corresponds to moving the second contact 2 in an opposite direction 6 with respect to the first contact 1.

The first contact 1 contacts the second contact 2 along a contacting region 8. Along this contacting region 8, the first contact 1 exerts a contact force 10 on the second contact 2. To generate the contact force 10, the first contact 1 may be elastically deflected in a deflected state shown in FIG. 1. The first contact 1 may be formed from sheet metal through stamping and/or bending.

To increase the contact force 10, the contacting region 8 includes a contacting portion 12 which is convexly curved towards the second contact 2. The contacting portion 12 is positioned on an outer surface of the contacting region 8, and extends away from a connecting end 16 (discussed below) of the first contact 1. The contacting portion 12 may be generated by cold forming the first contact 1. A base of the contacting portion 12 may be circular so that the contacting portion 12 forms a spherical cap. The contacting region 8 establishes a point of contact with the second contact 2 at a contact point 13. Additionally, the contacting portion 12 generates a contact pressure sufficient to penetrate an oxidized layer disposed on a surface of the second contact 2.

In an embodiment, the second contact 2 may be of a simple geometric shape, such as a straight planar contact spring which extends along the mating direction 4 and/or the opposite direction 6.

The first contact 1 has a looped spring portion 14 having a connecting end 16 and a contacting end 18. The contacting end 18 is bent back towards the connecting end 16 to form an approximately circular loop 20, which may be continuously and partially curved along at least one contiguous region 22 toward the contact region 8. A continuous curvature is achieved if centers of curvature are located at the same side of a loop (see loop 20 discussed below) for a given length of the looped spring portion 14. Thus, in the continuous curvature, the curve does not change its principle direction.

In an embodiment of FIG. 1, the contacting end 18 includes three contiguous regions 22, which may optionally be connected by intermediate straight regions 23. In an embodiment (not shown), the contacting end 18 includes 2 contiguous regions 22, or four or more contiguous regions 22. The looped spring portion 14 forms a furled leaf spring.

In an embodiment where there are several continuously curved regions 22, the curved region 22 most remote from the contacting region 8 has a smaller curvature than the other curved regions 22, which would have an approximate curvature of the same size. The curved regions 22 collectively correspond to a central region 22. The central region 22 may have a relatively small radius, and when combined with a large lever on the connecting end 16, permits the contact force 10 thereon to generate a high degree of flexibility in the central region 22.

The contacting region 8 is positioned proximate to the contacting end 18. The first contact 1 may terminate at the contacting end 18 so that the contacting end 18 is cantilevered, with the contacting end 18 being a free end 24 and the connecting end 16 being a fixed end of the cantilevered first contact 1. In an embodiment, the contacting end 18 curves such that the free end 24 curves to point in a direction away from the contacting region 8. Such a configuration is advantageous if the first contact 1 and the second contact 2 are to be spaced apart at a large distance. When a close spacing is required between the contacts 1, 2, generally in applications where high-, very high-, or ultra-high frequency radiation has to be shielded. In such applications, for the shielding (discussed below) to be effective, gaps in the shield may not be larger than a quarter of an applicable wavelength.

In an embodiment, the circular loop 20 is planar along opposing edges extending the length of the circular loop 20, such that the sheet material from which the first contact 1 is made is not bent out of the plane of drawing in FIG. 1.

The looped spring portion 14 at least partially surrounds and defines an approximately circular passageway 28 extending orthogonally to the mating direction 4, in a width direction. The circular passageway 28 has a gap 30 formed from the connecting end 16 being spaced a first separation distance 31 apart from the contacting end 18. The loop 20 forms an arc 32 extending from the connecting end 16 to the contacting end 18. In an embodiment, the looped spring portion 14 extends over at least one third of the length of the loop 20, whereby the length of the looped spring portion 14 is measured along a perimeter thereof.

In an embodiment, the arc 32 extends around a central region 34, between the contacting end 18 and the connecting end 16, between 60° and 120°. In an embodiment, the arc 32 extends around the central region 34 for at least approximately 180°. In an embodiment, the arc 32 extends around the central region 34 for at least approximately 225°. In an embodiment, the arc 32 extends around the central region 34 for at least approximately 270°. In an embodiment, the arc 32 extends around the central region 34 of less than approximately 330°. In an embodiment, the arc 32 extends around the central region 34 for less than approximately 360° to leave sufficient space between the contacting end 18 and the connecting end 16.

The connecting end 16 may be formed on a first contact base 36 of the first contact 1. The first contact base 36 may be used to attach the first contact 1 to the electrical connector associated therewith. In an embodiment of FIG. 1, the first contact base 36 continuously connects with the connecting end 16 of the looped spring portion 14. At the connecting end 16, the looped spring portion 14 may have a curvature with a different shape than that of the curvatures of the remaining contiguous regions 22 of looped spring portion 14. At the connecting end of the looped spring portion 14, the first contact 1 may extend in a direction away from the contacting region 8, towards the looped spring portion 14. The first contact base 36 may be, for example, blade- or pin-like so that the first contact base 36 may be seated in a contact seat disposed on the electrical connector 76. In an embodiment of FIG. 3, the first contact base 36 may be continuously connected to a housing element of the electrical connector, such as a connector shield 58 (discussed below).

When a first contact height 42 of the looped spring portion 14 is defined as the distance between the contacting region 8 and the remotest point from the contacting region 8 in the loop 20, in a direction perpendicular to the mating direction 4, then a separation distance 44 corresponding to the distance between the contacting region 8 and the contacting end 18 is less than half the height. In an embodiment, the separation distance 44 is between a fifth and a third of the first contact height 42. The first separation distance 31 between the connecting end 16 and the contacting region 8 may be less than a second separation distance 48 between the connecting end 16 and an outer spring region 50 of the looped spring portion 14, said outer spring region 50 being a region of the spring portion 14 positioned furthest away from the contacting region 8. In an embodiment, the second separation distance 48 is less than half the distance 46, preferably between one fifth and a third of the distance 46.

In an embodiment of FIG. 1, a high degree of flexibility is desired for movements of the contacting region 8 in the plane 52 of the circular passageway 28. The directionality of this flexibility, i.e. the deflectability of the contacting region 8 along the mating direction 4 and perpendicular thereto, is influenced by the geometry of the looped spring portion 14. A balanced flexibility in these two directions may be reached by using a looped spring portion 14 having an outer contour approximating or corresponding to a circular section. By deviating from this shape, such as through elongation, the directions of the flexibility may be influenced. Flexibility may be also influenced by adding at least one straight intermediate region 23 and/or by having the looped spring portion 14 ending in a linear contacting portion 54, which, at its end, terminates with the contacting region 8 at its free end 24.

The linear contacting portion 54 may also serve as an approach slope: If the opposing second contact 2 is removed and the looped spring portion 14 is in a relaxed state, the linear contacting portion 54 may be inclined against the mating direction 4, the free end 24 facing against the mating direction 4. Thus, if the first contact 1 and the second contact 2 are being fit together, a mating end 56 of the second contact 2 may first contact the linear contacting portion 54 and then, by elastically deforming the looped spring portion 14 into the shape shown in FIG. 1, slide along the linear contacting portion 54 until the contacting region 8 is reached. At this point, the linear contacting portion 54 may approximately be oriented parallel to the mating direction 4.

The loop 20, or the circular passageway 28, may be positioned behind the connecting end 16 and/or the contacting end 18. The loop 20 may be the foremost part of the first contact 1 by facing the mating direction 4.

In an embodiment of FIG. 1, the first contact 1 is particularly suited for use in high vibration environments, where there is a danger that high-frequency vibrations overcome the static friction between the contacting region 8 and the second contact 2. From this, a relative scratching movement between the contacting region 8 and the second contact 2 would result which would quickly cause wear to both the first contact 1 and the second contact 2. By using the looped spring portion 14, such relative vibrational movement, and thus the resulting excessive wear, is avoided. As shown in the embodiment of FIG. 2, excessive wear is avoided since the contacting region 8 is supported flexibly and may follow any vibrational movement of the second contact 2 without a notable loss of contact force 10.

Figure 2:
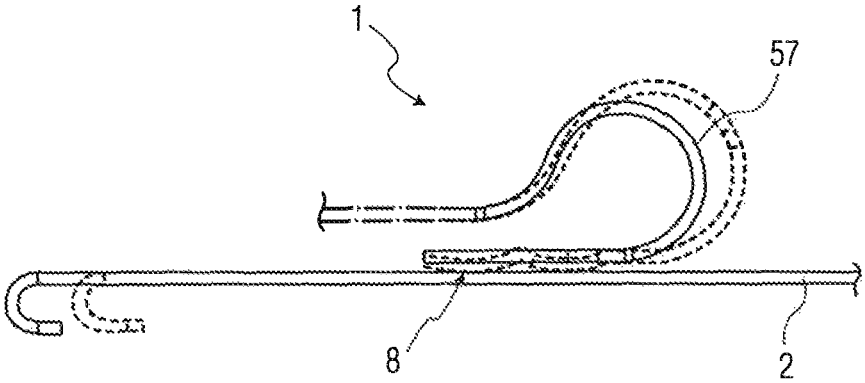
FIG. 2 is a sectional side view of the electrical contact in both in an initial and a deflected state.

In an embodiment of FIG. 2, the broken lines show the first contact 1 in a relaxed position shown in the embodiment of FIG. 1. In bold lines, a deflected position, due to a vibrational movement of the second contact 2, is depicted. The contacting region 8 may respond to large vibrational amplitudes along the mating direction in that the looped spring portion 14 is deformed, while the contacting region 8 remains in contact with the second contact. Additionally, the contacting region 8 may also follow vibrational movement in the width directions, perpendicular to the mating direction 4.

Figure 3:
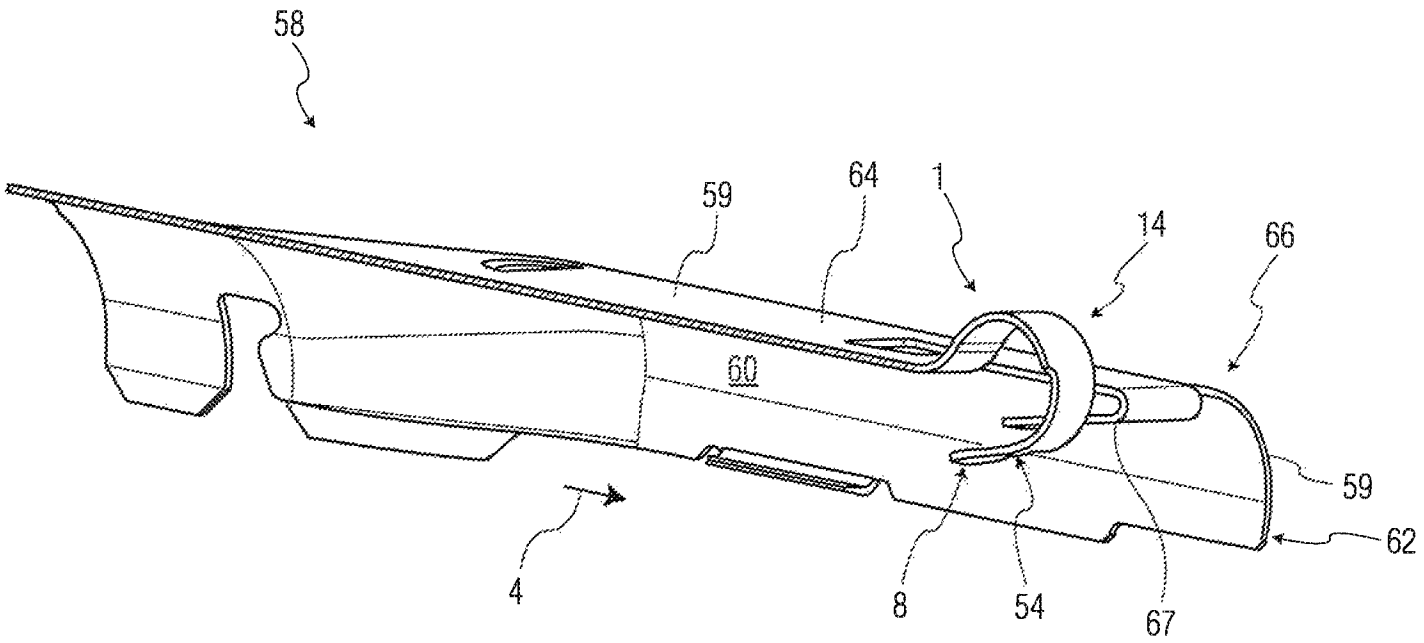
FIG. 3 is a sectional view of a shielding body having the electrical contact.

In an embodiment of FIG. 3, a connector shield 58 is shown without the other parts of the electrical connector and without the parts of a mating connector. The connector shield 58 has a contact receiving space 60, in which other contact elements and part of a cable on which the connector is mounted may be received on three sides with faces 39.

Through a contact receiving opening 62, the components of the mating connector may be inserted. The connector shield 58 may be assembled from several parts, such as two complementary shell-like halves 64, as shown in an embodiment of FIG. 3. The connector shield 58 is connected, at a terminating end opposite the contact receiving opening 62, to the shielding of a cable (not shown). The connector shield 58 may then be connected by an intermediate shield member (not shown) of the mating connector to the shield of the cable to which the mating connector is connected.

In an embodiment of FIG. 3, the first contact 1 is integrated into the structure of the connector shield 58 or its constituent parts, such that the first contact 1 extends continuously therefrom. In an embodiment, the first contact 1 and the connector shield 58 may be stamped and bent from the same metal sheet. The contacting region 8 may face and/or project into the contact receiving space of the shield 60. The looped spring portion 14 may protrude outwards, away from the contact receiving space 60, extending outward from an outer surface of the connector shield 58. The first contact 1 may be positioned at a mating end 66 of the connector shield 58, the mating end 66 pointing in the mating direction 4. The linear contacting portion 54 may be inclined relative to the mating direction 4. The first contact 1 may further include additional contacts 67, which ensure additional contact with the second contact.

Figure 4:
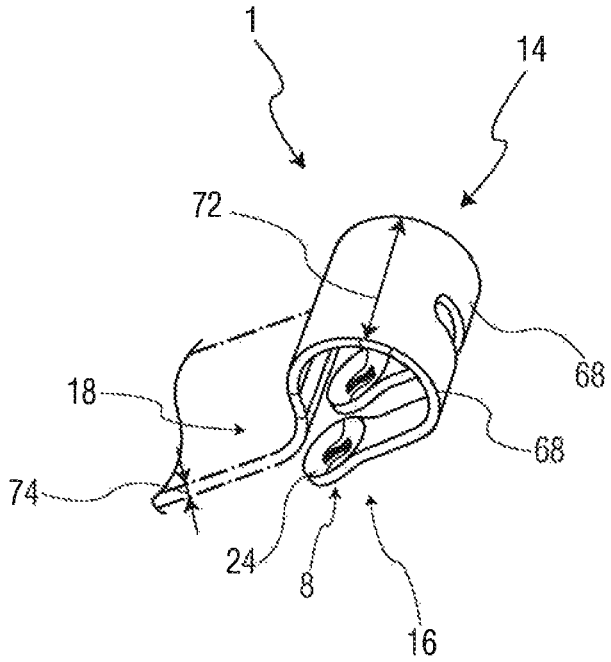
FIG. 4 is a perspective view of an electrical contact.

In an embodiment of FIG. 4, to ensure that even under exceptionally strong vibrations, that there is an electrically conductive contact between the first contact 1 and the opposing contact element, the first contact 1 has a plurality of contacting regions 8. In an embodiment of FIG. 4, the looped spring portion 14 may be split in a plurality of contact arms 68, which run parallel and each of which have at least one contacting region 8 disposed on an outer surface thereof.

The contact arms 68 have a length that extends over more than half of the total length of the looped spring portion 14, as measured along the arc 32. Each contact arm 68 has a cantilevered free end 24, onto which the contacting region 8 is individually positioned, and an opposite cantilevered fixed end (not labeled) that extends continuously from the looped spring portion 14. A cross-sectional area of the looped spring portion 14 at the contacting end 18 may be smaller than the cross-sectional area of the first contact 1 at the connecting end 16. This may be achieved by reducing a width 72 of the first contact 1 at each individual contact arm 68 but leaving the material thickness 74 unchanged. The material thickness 74 is defined by the thickness of the metal sheet from which the first contact 1 and/or the shield 58 is produced.

Figure 5:
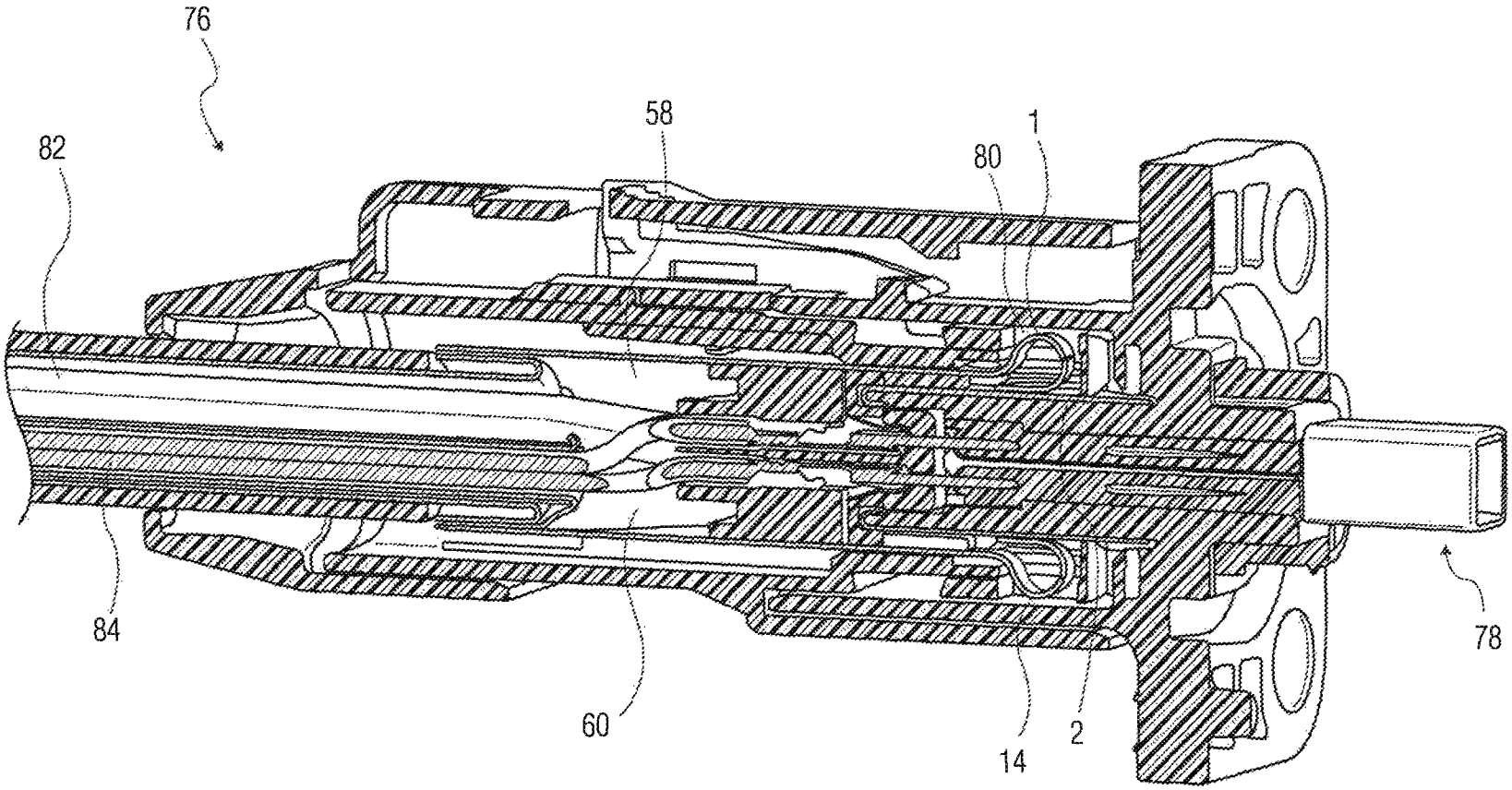
FIG. 5 is a sectional side view of an electrical connector having a shielding body with the contact element.

A cross-sectional view of an electrical connector 76 is shown in an embodiment of FIG. 5. The electrical connector 76 is shown in a mated state, where the electrical connector 76 is mated to a complementary mating connector 78. The first contact 1 contacts the complimentary second contact 2. The looped spring portion 14 protrudes outwards into a receiving space 80, such as a blind end, a seat or other similar structural features known to those of ordinary skill in the art.

In an embodiment of FIG. 4, the connector shield 58 may be of a sleeve-like shape and be electrically connected to a cable 82, in particular through the cable shield 84 of its cable 82.

One of ordinary skill in the art would appreciate that the above embodiments are intended to be illustrated, and not restrictive. For example, many modifications may be made to the above embodiments by those skilled in this art, and various features described in different embodiments may be freely combined with each other without conflicting in configuration or principle.

Although several embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical contact for an electric connector, comprising:

an approximately circular looped spring portion having
- a connecting end;
- a contacting end curved back towards the connecting end; and
- at least one contacting region positioned on the contacting end, the contacting region having a convexly curved contacting portion positioned on an outer surface and extending away from at least one of the looped spring portion and the connecting end.

2. The electrical contact according to claim 1, wherein the looped spring portion includes a contiguous region that continuously curves in a first direction towards the contacting region.

3. The electrical contact according to claim 1, further comprising a first contact base continuously connected with the connecting end, and attaching the electrical contact to the electrical connector.

4. The electrical contact according to claim 2, wherein a portion of the connecting end curves in a second direction, contrary to the first direction of curvature of the contiguous region.

5. The electrical contact according to claim 2, wherein, at the connecting end, the looped spring portion first extends away from the contacting region before merging with the contiguous region.

6. The electrical contact according to claim 1, wherein the contacting region is positioned opposite the connecting end, and has a gap therebetween.

7. The electrical contact according to claim 1, wherein a cross-sectional area of the electrical contact at the connecting end is larger than a cross-sectional area of the electrical contact at the contacting end.

8. The electrical contact according to claim 1, wherein, at the contacting end, the looped spring portion terminates in a linear contacting portion, which includes the contacting region.

9. The electrical contact according to claim 1, wherein the looped spring portion is cantilevered, with the contacting end being a cantilevered free end.

10. The electrical contact according to claim 9, wherein the contacting region is positioned on the free end.

11. The electrical contact according to claim 1, wherein a first separation distance between the connecting end and the contacting end is approximately a third to a fifth of a total height of the looped spring portion.

12. The electrical contact according to claim 1, wherein the looped spring portion at least partially surrounds and defines a circular passageway having a gap positioned between the contacting end and the connecting end.

13. The electrical contact according to claim 1, wherein a cross-sectional area of the looped spring portion is less than a cross-sectional area of the looped spring portion positioned proximate the contacting end.

14. The electrical contact according to claim 1, wherein the looped spring portion forms an arc extending from the connecting end to the contacting end, the arc extending for at least 270°.

15. The electrical contact according to claim 1, wherein the looped spring portion includes a plurality of contact arms extending approximately in parallel to each other, each contact arm having at least one contacting region positioned on the contacting end.

16. The electrical contact according to claim 15, wherein each contact arm is cantilevered, terminating in a cantilevered free end.

17. The electrical contact according to claim 15, wherein the contact arms have a length that extends over more than half of a total length of the looped spring portion.

18. An electrical connector comprising:

an electrical contact having a mating end and an opposite terminating end with an approximately circular looped spring portion positioned proximate to the mating end and having a connecting end positioned proximate to the terminating end;

a contacting end positioned proximate to the terminating end, and being curved back towards the connecting end; and at least one contacting region positioned on the contacting end, the contacting region having a convexly curved contacting portion positioned on an outer surface and extending away from at least one of the looped spring portion and the connecting end.

* * * * *